United States Patent [19]

Guarrera

[11] 4,123,808

[45] Nov. 7, 1978

[54] BATHTUB WITH SPRAY OUTLET CONVERTED TO RECTO-GENITAL CLEANSING DEVICE

[76] Inventor: Anthony T. Guarrera, 16-23 Third Ave., New York, N.Y. 10028

[21] Appl. No.: 783,261

[22] Filed: Mar. 31, 1977

[51] Int. Cl.[2] ..... A47K 3/22

[52] U.S. Cl. ..... 4/7; 4/6; 4/185 S

[58] Field of Search ..... 4/6, 7, 185 R, 185 S, 4/145, 146, 237, 236, 240, 234, 173 R, 175, 176

[56] References Cited

U.S. PATENT DOCUMENTS

| | | | |
|---|---|---|---|
| 205,490 | 7/1878 | Kuessner et al. | 4/7 |
| 2,752,610 | 7/1956 | Mabrey | 4/237 |
| 2,899,688 | 8/1959 | Hopkins | 4/185 S |
| 3,040,335 | 6/1962 | Gellmann | 4/185 S |
| 3,082,432 | 3/1963 | Pearlman | 4/7 |
| 3,528,112 | 9/1970 | Warnick | 4/7 X |
| 3,900,902 | 8/1975 | Jarosinski | 4/7 |
| 3,916,453 | 11/1975 | Armada | 4/7 |
| 3,936,891 | 2/1976 | Kulde | 4/7 |
| 3,947,898 | 4/1976 | Ducharme | 4/6 |

*Primary Examiner*—Henry K. Artis

*Attorney, Agent, or Firm*—Kirschstein, Kirschstein, Ottinger & Cobrin

[57] ABSTRACT

A bathtub which has been converted into a selectively usable, facile, feminine recto-genital cleansing apparatus, by spanning the side rims of the tub with a swing-away seat having a large opening over which a user places her recto-genital area. The seat is provided with a horizontal forward protrusion which is so shaped and dimensioned that when the seat is straddled by a user her genitalia are transversely spread to expose and open her vagina, as well as to present the surrounding spread vulvar cleft for flushing thereof. The bathtub is equipped with a shower arm from which the shower head has been removed and replaced by a flexible conduit that runs to a stand placed on the bottom of the bathtub on the front-to-back center line thereof. The stand supports a swivelable spray head that is adapted to be so manually placed on the floor of the bathtub that water issuing from the head will be directed at the now accessible user's rectogenital area. The stand further includes a manually controllable valve to enable the user to regulate the pressure of the spray and to turn the spray off or on at will.

8 Claims, 5 Drawing Figures

BATHTUB WITH SPRAY OUTLET CONVERTED TO RECTO-GENITAL CLEANSING DEVICE

BACKGROUND OF THE INVENTION

1. Field of the Invention

A shower equipped bathtub converted to a feminine recto-genital cleansing apparatus.

2. Description of the Prior Art

It long has been recognized that the recto-genital area is benefited by frequent cleansings to minimize irritation and infection, eliminate odors and remove residues from bodily excretions. For anatomical and hygienic reasons, women in particular exert special efforts to maintain this area clean. Attempts to clean the area with topically applied sheets of soft material are futile. An alternative approach, namely laving said area in shallow bowls, e.g. sitz baths, has been practiced for centuries. More recently, bidets have been employed, these constituting bowls with nozzles in their bases to direct sprays of water at the recto-genital area.

Two patented types of conversion equipment have been suggested to incorporate rectal baths in a bathtub: these are U.S. Pat. Nos. 3,040,335 and 3,082,432.

In the first of these the shower head is removed from a shower arm and replaced with a flexible conduit that supplies water under pressure to sundry nozzles including one beneath an opening in a seat for a user; this nozzle is oriented to direct a spray at the user's rectal area and toward the genital area. In this patent the seat has no accounterments to compel a woman to spread her genital area sufficiently to provide ready access to an opened vagina and the surrounding vulvar cleft in order to permit a spray to obtain maximum flushing.

In the second patent a seat likewise is provided with a rectal spray, the spray being attached to the bathtub spout rather than the shower head; the seat has no accounterments to compel placement of the user's legs in such a position as to open and expose the vagina and surrounding area.

Nether of these patents includes a single easily available control for regulating the rate of discharge for the spray, so that the user is forced to stretch out in order to reach the wall-mounted handles.

SUMMARY OF THE INVENTION

1. Purposes of the Invention

It is an object of this invention to provide a converted shower equipped bathtub with a swing-away seat and which compels a seated woman to spread her legs to such a degree that the vestibule to her vagina is opened wide and the vulvar area is fully exposed for impingement of a spray.

It is another object of the invention to provide a converted bathtub of the character described which is very efficient, comfortable and pleasing to use for the mentioned purpose.

It is another object of the invention to provide a converted bathtub of the character described which constitutes relatively few, inexpensive and simple parts, and is rapidly and easily changed from a conventional shower equipped bathtub and, indeed, can be readily changed back for conventional bathing.

It is another object of the invention to provide a converted bathtub of the character described in which the seat can be rapidly and readily moved between an out-of-the-way and an in-use position.

It is another object of the invention to provide a converted bathtub of the character described which enables a woman to quickly adjust the position of the spray so as to direct the same at an angle which best suits her personal genital anatomy.

It is another object of the invention to provide a converted bathtub of the character described which enables a woman to wash the area involved, not only thoroughly, but quickly.

Other objects of the invention in part will be obvious and in part will be pointed out hereinafter.

2. Brief Description of the Invention

The present invention is concerned with the conversion of a standard shower equipped bathtub into a combination which can be used with utmost efficiency for water cleansing of a woman's rectal and genital areas. The bathtub is conventional. Indeed, it is a feature of this invention that an ordinary bathtub such as is found in almost every home can be converted into a cleansing device of the character under consideration, the conversion being such that the bathtub can be used at will either in its ordinary manner or as a cleansing device.

The bathtub preferably is of the so-called recessed type, that is, a bathtub having an apron which extends to the floor on an outer side and a rim which extends to a wall on an inner side parallel to the apron.

The remaining rims are at the head and foot ends of the bathtub and may extend to walls or one of them may include a floor length apron. The rims are coplanar and approximately flat.

The bottom of the bathtub at the head end is slightly higher than at the foot end. The bathtub has the usual drain opening. At the foot end of the bathtub a hot water valve, a cold water valve or a mixing valve, a spout, a shower/spout director and a drain control are provided. Furthermore, the bathtub has an associated elevated shower arm projecting from a wall of the room above the foot end.

The bathtub is converted from its conventional use to its recto-genital flushing use by installing certain equipment. This includes a seat which is adapted to have its opposite sides rest on the side rims near the head end of the bathtub. The seat is permanently connected to a bathroom wall, preferably the head wall. This connection, desirably, is such as to permit the seat to be swung from a horizontal position resting on the side rims to a vertical out-of-the-way position substantially flat against the head wall. A hinge is employed for this purpose.

The seat is of special construction, being such, as mentioned previously, that when a woman sits on it her recto-genital area will be exposed through an opening in the seat. This, however, is not sufficient. The seat must be such that the recto-genital area including the vaginal vestibule is totally exposed for efficient rinsing thereof. To this end and in order to compel the woman who uses the seat to spread her legs sufficiently for the aforesaid purpose, the seat includes a horizontal protrusion coplanar with the remainder of the seat and located at the front center of the seat. The protrusion includes two flanks on the outside of which a woman places her thighs while her feet rest on the bottom of the tub and her buttocks rest on the seat. The flanks are spaced apart a substantial distance sufficient to compel the woman to open her legs enough to spread her major and minor labia and also to transversely spread the cleft of the vulva to an extent such that not only is the recto-genital area totally exposed, but the mouth of the vaginal canal is opened whereby to permit flushing of the vestibule thereof.

The second piece of equipment used for the conversion of the bathtub is a water spray, means for supporting the spray on the bottom of the tub, and a conduit for leading pressurized water to the spray. Specifically, the seond piece of equipment constitutes a stand which can be manually placed on the bottom of the tub by the user and, when so placed, will be in stable equilibrium that is to say, will not rock. The stand supports a spray head, for example, a spray head such as a conventional shower spray head. Desirably the spray head is swivelably attached to the stand so that its angle can be adjusted to one proper for the anatomy of the user. A passageway leads from an inlet to the spray head to the outlet from a nearby controllable valve which, desirably, is supported by the stand. The nearby valve thus can be readily grasped by a woman on the seat without rising or without stretching to manipulate the usual valve handles of foot end of the tub. The inlet to the nearby valve is coupled to one end of a flexible conduit, the other end of which is screwed on the free end of a shower arm from which the shower head has been unscrewed. The proper volume and temperature of water is obtained by adjusting the usual valve handles while the water is permitted to flow through the bath spout. AT this time the nearby valve is closed. Then the spout/shower diverter valve handle is manipulated to direct water to the nearby valve. Finally, the user, while seated operates the nearby valve to spray her recto-genital area.

At the time of an individual's first use, the angle of the spray is adjusted to obtain a correct spray angle for that person. Thereafter, this need not be changed unless a different user employs the cleansing device and wants to alter the spray angle and position on the bottom of the tub to suit her uniquely singular anatomical genital structure.

The invention consists in the features of construction, combinations of elements, and arrangement of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention.

PREFERRED EMBODIMENT OF THE INVENTION

Figure 1:
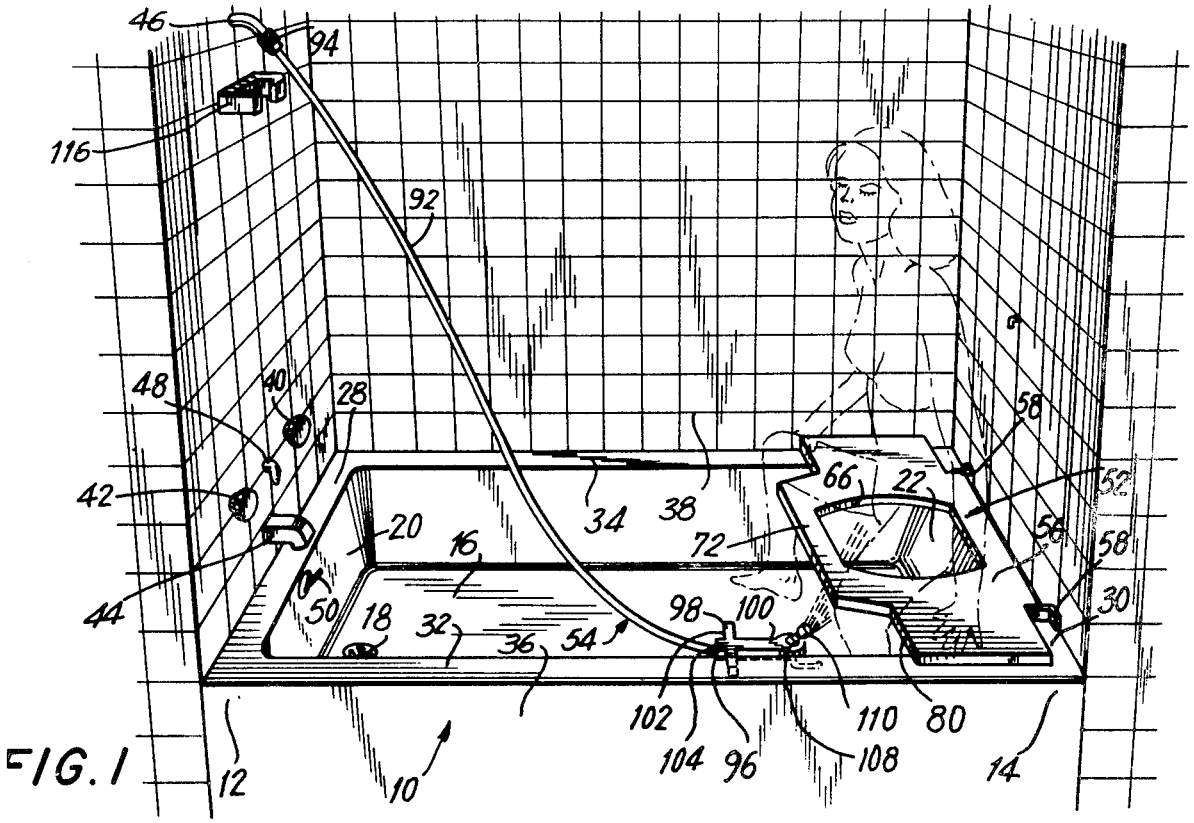
FIG. 1 is a perspective view of a converted bathtub in use.

Referring now in detail to the drawings, the reference numeral 10 denotes a conventional recessed bathtub. The illustrated tub has been set into an alcove, a position in which it frequently is found in homes. The tub may be of any standard construction, e.g. porcelain or iron enamel. It has the usual foot end 12 and head end 14 between which a bottom 16 extends. The bottom slopes downwardly from the head end to the foot end in order to facilitate flow of water out of a drain 18 in the bottom at the foot end. The tub includes the usual foot wall 20, head wall 22 and side walls 24, 26. Each wall terminates at the top of the tub in a rim section, respectively 28, 30, 32, 34. The rim sections usually are flat, being so illustrated in the drawings, and they lie in a common horizontal plane, the ends of adjacent rim sections running into one another.

The front of the tub, which is the long portion that faces into the room conventionally is provided with an apron 36 that extends from the outer edge of the outer side rim section 32 to the floor of the bathroom. In order to prevent deterioration of the walls around the tub, the same are provided with tiles 38 or some other suitable water-impervious surface.

Cold and hot water handles 40, 42 protrude from the wall at the foot end of the tub. These handles are connected by spindles to cold and hot water valves set in the wall. Cold and hot water, respectively, run through these valves to one of two outlets. One outlet is a spout 44 for delivering a solid stream of water into the tub. The spout extends from the wall over the foot rim section 28 to a mouth that directs water downwardly into the tub. The other outlet is a shower arm 46 that projects from the wall at the foot end of the tub. The free end of the shower arm usually is provided with a male thread onto which a coupling is secured that connects the shower arm to a shower head. Pursuant to the present invention, this shower head is unscrewed to remove it.

There further is provided, in connection with the water supply system, a diverter handle 48 in the wall above the foot end of the bathtub. This handle controls a diverter valve and is manually manipulatable between two positions, in one of which water controlled by the hot and cold water valves is directed to the spout 44, and in the other of which such water is diverted to the shower arm.

To complete the description of the tub, although it is not relevant to the instant invention, a drain handle 50 is emplaced in the foot wall of the bathtub. This handle is manually movable between two positions, in one of which it prevents water from running through the drain 18, and in the other of which it permits egress of water through said drain.

As thus far described and except for the mention of removal of the shower head, the bathtub and its accessories are entirely conventional. Indeed, it is the purpose of the present invention to convert a conventional bathtub, of which the one illustrated and just described is typical, into a cleansing device such as described heretofore. To repeat what has been said earlier in the Brief Description of the Invention, the conversion is accomplished by adding to the bathtub two pieces of equipment. One is a seat 52 and the other is external plumbing 54.

The seat 52 serves two functions. One is to provide a place on which a woman can sit over the tub while cleaning her recto-genital region, and the other is to spread and expose this region for thorough cleansing thereof with the assistance of the external plumbing 54.

For the first function, the seat simply constitutes a flat platform 56 of large enough size to support the buttocks and undersides of the thighs of a seated woman, and the configuration of the seat, so far as this function is concerned, is not critical. A flat surface will suffice, although the surface can be rounded to improve its esthetic appearance. The seat can be composed of molded plastic or wood or any solid board-like material which can, if desired, be covered with enamel or a plastic lamination.

Figure 2:
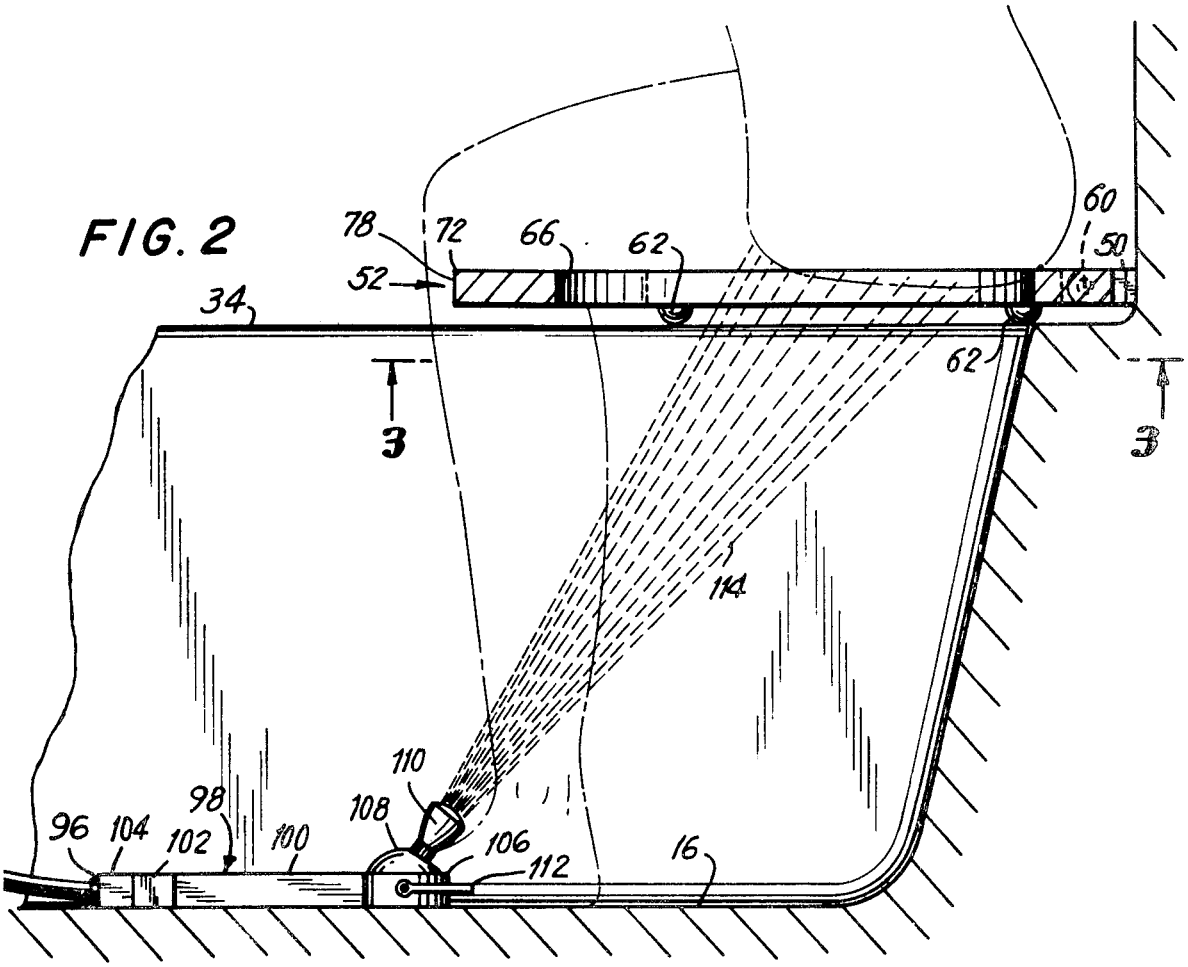
FIG. 2 is a foot-to-head end enlarged fragmentary sectional view of the converted bathtub.
Figure 5:
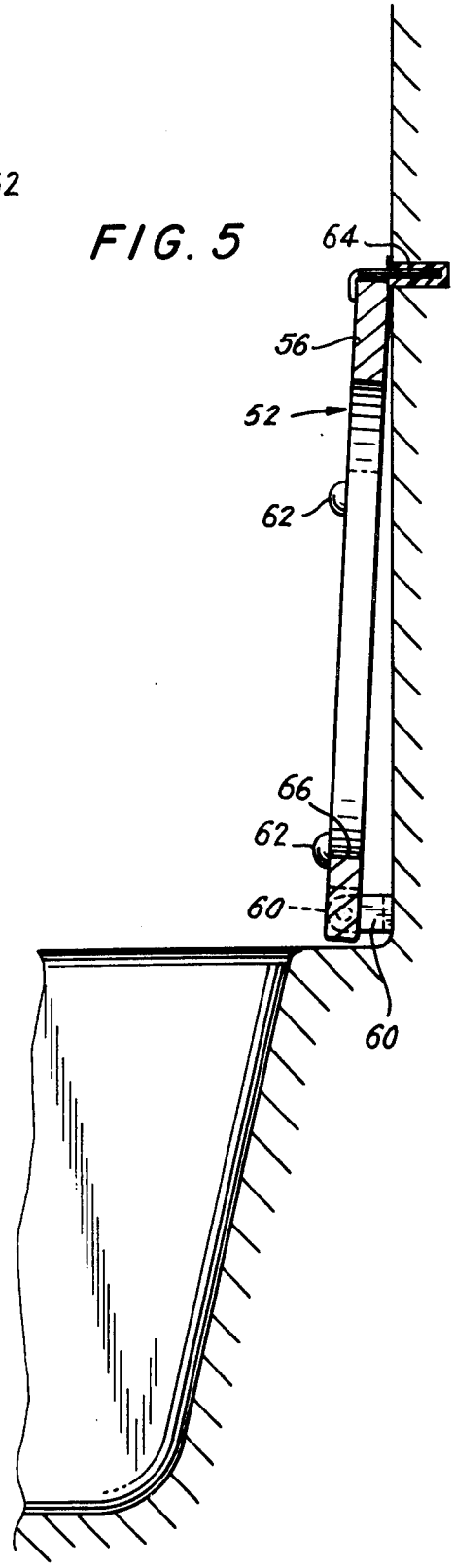
FIG. 5 is a fragmentary sectional view taken substantially along the line 5—5 of FIG. 4.
Figure 4:
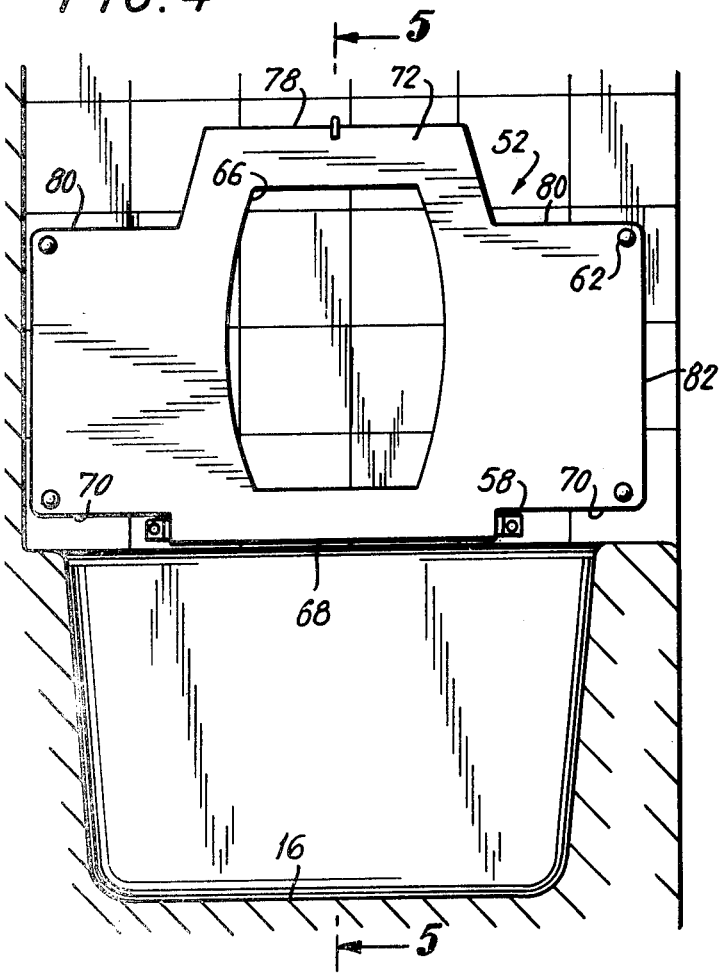
FIG. 4 is a front view of a converted bathtub, the seat being shown in swung-away position.

Pursuant to a preferred form of the invention, the seat is permanently installed adjacent the bathtub, desirably in such a manner that it can be moved from a flat horizontal position, as shown in FIGS. 1 and 2, to a substantially vertical raised, swung-away position shown in FIGS. 4 and 5 which does not interfere with the conventional use of the bathtub for bathing.

A suitable connection to effect the foregoing movement is a hinge that attaches the platform adjacent its rear edge to the wall of the room in back of the head end of the tub. As shown, the hinge includes a pair of L-shaped brackets 58 having one leg anchored to the aforesaid wall of the room. The other legs of the two brackets extend horizontally over the head end rim section 30 of the bathtub, being vertically close to the same. These latter two legs have horizontal pins 60 secured thereto and extending toward each other in the space between the two brackets. Said pins are received in blind bores (not shown) adjacent the rear edge of the platform, the blind bores and the pins being aligned horizontally and parallel to the wall of the room at the head end of the bathtub.

The platform in its operating position (shown in FIGS. 1, 2 and 3) is horizontal and rests on the side rim sections 32, 34. Bumpers 62 on the underside of the platform are included to cushion the contact between the seat and the bathtub and also to prevent scratching of the glazed finish of the tub. The raised swung-away position of the platform is illustrated in FIGS. 4 and 5 where it will be seen that the seat has lifted to a slightly off-vertical rearwardly-inclined orientation in which its top leans against the wall of the room above the head end of the bathtub.

Means is included to selectively maintain the platform in this idle swung-away raised position, such means comprising an L-headed screw 64, the threaded shank of which is inserted into this wall of the room in such a fashion that the screw is free to turn. When the platform is to be swung to its out-of-the-way position, the head of the screw is turned so that the L-finger thereof faces upwardly, permitting the top of the platform to pass under the head. Thereafter, the finger is turned to face downwardly, as shown in FIGS. 4 and 5, and keep the platform in its upstanding position in which it will not interfere with a person who wishes to bathe in the tub.

In order to enable the second mentioned function to be effected, the configuration of the platform is quite critical. Firstly, it is necessary to include a large central opening 66 which is sited substantially at the center of the platform and therefore on the foot-to-head center line of the bathtub. The shape of the opening is not critical. It simply has to be large enough and it has to be situated so that a woman sitting on the platform over the opening will expose her recto-genital area in a manner which will be detailed hereinafter.

A typical suitable opening such as the opening 66 shown in the drawings has a dimension of 13 inches in a head-to-foot direction and is 7 inches across at its head end and at its foot end. It is 10 inches across at its maximum side-to-side width. A suitable configuration is the one illustrated which is a truncated ovoid, the two ends being straight and parallel to each other and perpendicular to the sides of the tub, and the sides of the opening being inwardly concave and symmetrically disposed with respect to the foot-to-head center line of the opening.

The corners of the head edge 68 of the platform are broadly notched as at 70 to provide space for the brackets 58. The total width of the platform is sufficient to enable the platform to rest firmly on the side rim sections 32, 24 as mentioned earlier. A suitable dimension for this purpose, keeping in mind the conventional sizes of bathtubs, is about 27 inches. The distance from the head end of the opening 66 to the head edge 68 of the platform is small enough to provide for good exposure of the recto-genital area as aforesaid, this typically being 3 inches.

As thus far described, the platform is shaped and dimensioned to serve only the first of its functions, namely, the support of a woman thereon with her recto-genital area above an opening through which, obviously, a spray will be directed. This, however, is not sufficient, in accordance with the instant invention, for the mere placement of this area above the opening will not enable such area to be quickly, gently and thoroughly cleansed by spraying of water thereon.

The platform, therefore, pursuant to the invention here under consideration, is uniquely constructed to compel a woman seated thereon to transversely spread her legs and thereby to spread her genitalia, i.e. vulva, and furthermore to open her vagina and present the spread cleft of the vulva surrounding the same to the action of the spray. The shaping of the platform necessary to achieve the aforesaid desiderata constitutes the inclusion as a part of the platform of a forward protrusion 72 which is substantially coplanar with the remainder of the platform and, indeed, as shown in the drawings, is truly coplanar therewith. It does not interfere with the operation of the invention if the central portion of the protrusion is raised since this is not engaged by any part of the body of the woman using the device. What is important about the protrusion is the location of its flanks 74, 76. It is these flanks which are designed to be engaged by the inner sides of the upper ends of a woman's calves immediately below her knees to compel the aforesaid desirable spreading.

A typical dimension for the front edge 78 of the protrusion is about 11 inches. A variation in this dimension of approximately 2 inches in either direction can be tolerated. Too great a length for this dimension can be extremely uncomfortable for some women, keeping in mind that the platform is designed to be used by any woman who wishes to, and too short a distance for this dimension would result in insufficient spreading of the vulva of some women to present the same in a proper condition for cleansing. The distance that the protrusion extends forwardly from the front edge 80 of the platform is not critical. An acceptable distance is about 4½ inches. This distance can be increased considerably, if esthetically desirable, as long as it leaves the head-to-foot side edges 82 of the platform long enough to provide a stable seat for a woman. In other words, these latter edges 82 should not be so short that the platform will tend to tilt downwardly when a woman sits on it. Her center of gravity should be well behind the edges 80. If the front-to-back distance between the edges 78 and 80 is too short, there will be insufficient room to accommodate the woman's calves, so that a distance of less than about 3½ inches is not desirable. The edges 74, 76, both for the sake of appearance and for comfort, desirably are inclined toward each other, the included angle being about 30°. The distance from the edge 78 to the head end edge of the opening 66 is small enough to form an opening 66 of good size, a typical dimension for this distance being 3 inches.

Figure 3:
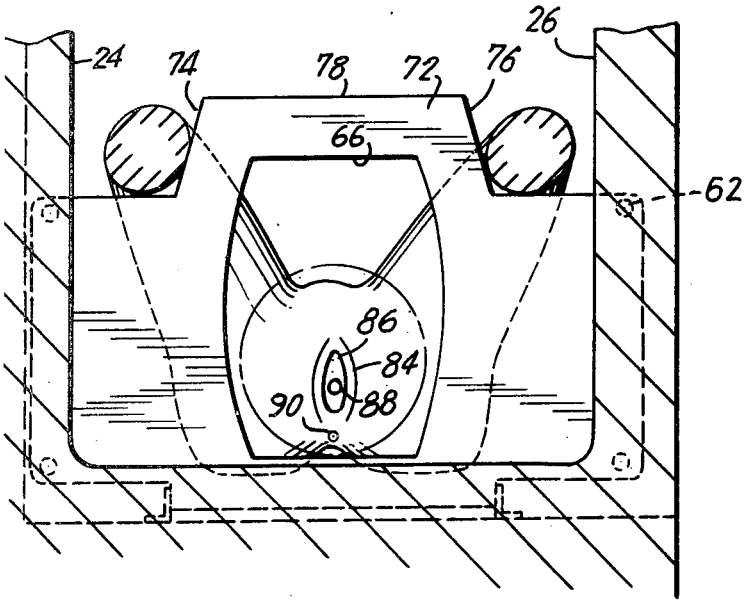
FIG. 3 is a fragmentary sectional view taken substantially along the line 3—3 of FIG. 2.

FIG. 3 best shows the spread condition of the various parts of the vulva when a woman is seated thereon. Of course, it will be understood that a woman using the present invention is unclothed when she employs the same, this being apparent from inspection of FIGS. 1, 2 and 3. When the woman is seated on the platform, the spreading of her legs causes the major and minor labia 84 to be spaced apart a distance sufficient to stretch the cleft 86 of the vulva and, in so doing, to open the mouth 88 of the vagina, thereby presenting not only the open mouth but the vestibule of the vagina behind the mouth to the action of a spray directed toward the same. Such spray thus will clean the vestibule of the vagina, the mouth of the vagina, the entire length of the spread vulvar cleft and the major and minor labia, all of these being transversely tensed to a mild degree. The anus 90 likewise is exposed by virtue of spreading of the buttocks so that it, too, is transversely mildly stretched for good access thereto of a cleansing spray.

The external plumbing 54 includes a flexible conduit 92, for example, a rubber hose, or, for better appearance, a suitable length of flexible armored tubing having an external sheath of a helically wound chromeplated strip. One end of the conduit mounts a female coupling 94 which is adapted to be screwed onto the male threaded free end of the shower arm 46. The coupling includes an internal washer (not shown) to prevent leakage. The minimum length of the conduit is seven feet. Seven and one-half feet is preferred.

The other end of the conduit is connected by a coupling 96 to the inlet end of a passageway (not shown) in a stand 98. The stand is intended to be placed on the bottom 16 of the tub in a position slightly forward of the center of the opening 66 when the platform 56 is in horizontal position. The actual placement of the stand is selected by the user and will, of course, depend upon the configuration of her particular anatomy. As a general rule, the stand is so placed that its head end is from about 0 to 15 inches forwardly (toward the foot end) of the center of the opening and it is for this placement that the aforesaid length of conduit is chosen. This length exceeds the conventional length (never more than five feet) of a conduit that is used for a hand held shower fixture and which is so short that it will not permit placement of a spray head on the bottom of a tub.

The stand is so configured that it will rest on the bottom of the tub in stable equilibrium, that is to say, there will not be any tendency for it to rock or tilt. A configuration which is suitable for this purpose is that illustrated, resembling a Latin cross with a straight shank 100 crossed by a bar 102 near its upper end to leave a stub 104. The end of the bar 102 remote from the stub 104 terminates in a knob 106. Thus, the stand has four reasonably widely spaced points of contact with the base of the tub, these being the opposite ends of the bar and the opposite ends of the shank. Such a broad area of contact inhibits any appreciable rocking movement of the stand so that when placed on the bottom of the tub as, for example, in the indicated position, it will tend to remain there and will not vibrate, for instance, during use causing it to "walk" around the tub and there change its position.

The passageway in the stand to which the coupling 96 is connected extends through the shank 100 to a socket (not shown) in which there is mounted a ball end 108 of a spray head 110. The ball mounting permits the spray head to have its angular position changed by hand to any position that the user desires. The stand further includes a handle 112 connected to a valve (not shown) in the shank 100. Operation of the handle will turn a spray 114 off or on and also will regulate its velocity.

The use of the converted bathtub is quite obvious. A woman, after shedding her clothes, lets down the seat but, before sitting, she manipulates the handles 40, 42 and the handle 48 to obtain a proper temperature of water flowing out of the spout 44 and to obtain a rate of flow which, from previous experience, she feels is suitable for use for cleansing of her recto-genital area. The handle 50 is left in the drain position. The handle 112 is turned to the off position. Next she manipulates the valve 48 to divert water from the spout to the shower arm 46. No spray yet issues from the head 110. Now she lowers herself onto the seat 52. Before seating, she stood in front of the protrusion 72 facing the foot end of the tub with her legs partly spread apart, the back of her knees resting lightly in the angles between the flanks 74 and front edges 80. This spread her legs somewhat apart, not enough, however, to compel the desired degree of opening of the crotch area. When she lowers herself on the seat, the recto-genital area expands transversely and creates the requisite opening and exposure of said area to the extent described in detail heretofore. She then reaches down, without need for stretching herself, to manipulate the handle 112 whereupon the spray will be directed in such a fashion as to achieve the desired cleansing action.

When she first uses the converted bathtub, she observes the setting of the hot and cold water handle to obtain a desired temperature that she wishes for the cleansing spray as well as the desired rate of flow. She will also observe the proper placement of the stand 98 to obtain an angle of impingement on her said area which will achieve a maximum cleansing effect. Once having done so, the next time she uses the device she will have no difficulty whatsoever in regulating the water and in properly placing the spray.

A woman can prepare herself and the converted bathtub for the desired cleansing action in a matter of less than a minute so that it need not interrupt her daily routine, and she will find that it performs the functions which previously took her considerable time and caused considerable inconvenience and never, indeed, resulted in an effectively clean area.

A further piece of equipment which is desirably employed in conjunction with the converted bathtub is a hanger 116, preferably placed on the wall of the room above the foot end of the tub. The hanger is shaped to receive the stand and hold it against the wall with the spray head slightly below the shower arm. In this position, the spray head can be used for a shower, thus obviating the necessity of disconnecting the coupling 94, so that the converted tub always is ready for a woman's sanitary use.

It thus will be seen that there is provided a device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention there is claimed as new and desired to be secured by Letters Patent:

1. In a bathroom including a first wall, a bathtub converted for facile recto-genital cleansing, (I) said bathtub comprising
- (A) a base,
- (B) a head end,
- (C) a foot end,
- (D) sides, and
- (E) a rim including portions at the sides, said side rim portions being horizontally coplanar, (II) said bathtub having its foot end against said first wall, (III) said bathroom having a second wall against the head end of the bathtub, (IV) said bathtub having associated therewith means for delivering water in a solid stream into the bathtub from a high point at the said first wall, (V) means for regulating the pressure and temperature of said stream of water, (VI) a shower arm, and (VII) means for selectively directing water to the shower arm or to the means for delivering the solid stream of water to the bathtub, and (VIII) that improvement including:
- (A) a seat having a large centrally disposed opening,
- (B) means for supporting said seat horizontally across the head end of the bathtub with the sides of the seat resting on the side rim portions of the bathtub,
- (C) said seat including a protrusion forward of the opening in the seat,
- (D) said protrusion having side edges which are spaced apart and against which the sides of a woman's calves adjacent to her knees are engaged when a woman sits on the seat to compel the woman to spread her legs and to transversely tense her vulvar cleft and to open her vagina to expose the mouth and vestibule thereof,
- (E) an elongated flexible conduit at least seven feet long and having one end connected to the free end of the shower arm,
- (F) a stand resting stably on the bottom of the bathtub near the head end thereof and supporting a spray head,
- (G) means connecting the other end of the conduit to the spray head,
- (H) said stand being disposed on the bottom of the bathtub centrally thereof and the conduit being long enough to locate the spray head slightly forwardly of the center of the opening,
- (I) said spray head being swivelably mounted on the stand and adjustable by the user to direct the spray when water is supplied to the head at an anatomically correct angle for the woman, and
- (J) means to connect the seat to the second wall of the bathroom for rotation about a horizontal axis between a horizontal position and an upright position.

2. A converted bathtub as set forth in claim 1 wherein the stand includes a valve to control emission of water from the spray head.

3. A converted bathtub as set forth in claim 1 wherein the stand has at least three points for engagement with the bottom of the tub.

4. A converted bathtub as set forth in claim 1 wherein means is included to swivelably support the spray head on the stand.

5. A converted bathtub as set forth in claim 1 wherein the width of the protrusion is 11 inches, plus or minus 2 inches.

6. A converted bathtub as set forth in claim 1 wherein the protrusion is a coplanar horizontal projection of the seat.

7. A converted bathtub as set forth in claim 1 wherein the stand is in the form of a cross.

8. A converted bathtub as set forth in claim 1 wherein the spray head is from 0 to 15 inches forward of the center of the opening in the seat.

* * * * *